US011777245B2

(12) United States Patent
Phon et al.

(10) Patent No.: US 11,777,245 B2
(45) Date of Patent: Oct. 3, 2023

(54) COIL SPRING TYPE WIRE-LOCKING TERMINAL BLOCK

(71) Applicant: Anytek Electronic Technology (Shenzhen) Co., Ltd., Guangdong (CN)

(72) Inventors: Waikong Phon, Guangdong (CN); Renchun Zhang, Guangdong (CN)

(73) Assignee: Anytek Electronic Technology (Shenzhen) Co., Ltd., Guangdong (CN)

( * ) Notice: Subject to any disclaimer, the term of this patent is extended or adjusted under 35 U.S.C. 154(b) by 72 days.

(21) Appl. No.: 17/564,178

(22) Filed: Dec. 28, 2021

(65) Prior Publication Data

US 2023/0026090 A1 Jan. 26, 2023

(30) Foreign Application Priority Data

Jul. 21, 2021 (CN) ..... 202110827565.7

(51) Int. Cl.
*H01R 13/428* (2006.01)
*H01R 13/436* (2006.01)

(52) U.S. Cl.
CPC ..... *H01R 13/428* (2013.01); *H01R 13/4361* (2013.01)

(58) Field of Classification Search
CPC ..... H01R 13/428; H01R 13/4361; H01R 9/2416; H01R 12/515; H01R 4/4863
USPC ..... 439/700, 709, 711
See application file for complete search history.

(56) References Cited

U.S. PATENT DOCUMENTS 4,759,726 A * 7/1988 Naylor ..... H01R 4/5008 439/441
6,270,383 B1 * 8/2001 Wielsch ..... H01R 4/4845 439/828
6,341,989 B1 1/2002 Jaag
7,115,001 B1 * 10/2006 Brockman ..... H01R 4/4827 439/828
7,354,319 B2 * 4/2008 Camino ..... H01R 4/4872 439/828
8,444,443 B2 * 5/2013 Schafmeister ..... H01R 4/4836 439/441

(Continued)

FOREIGN PATENT DOCUMENTS

CN 104767041 A 7/2015
CN 103490179 * 12/2016

(Continued)

*Primary Examiner* — Marcus E Harcum
(74) *Attorney, Agent, or Firm* — COOPER LEGAL GROUP, LLC

(57) ABSTRACT

This application discloses a coil spring type wire-locking terminal block, including a plurality of insulating seats arranged in sequence. A mounting groove is formed in each insulating seat. A wire inlet hole is formed in one side wall of the mounting groove. A connecting terminal is mounted at the bottom of the mounting groove, one end of the connecting terminal penetrates through the bottom of the mounting groove, and a first through hole is formed at one side of the connecting terminal. A wire locking frame is slidably connected in the mounting groove. A compression elastic member is arranged in the wire locking frame, and a second through hole is formed in the side wall of the wire locking frame. The wire inlet hole, the first through hole and the second through hole are arranged corresponding to each other.

7 Claims, 6 Drawing Sheets

(56) References Cited

U.S. PATENT DOCUMENTS

| | | | | |
|---|---|---|---|---|
| 8,480,441 | B2 * | 7/2013 | Wu | H01R 4/4836 439/716 |
| 9,601,844 | B2 * | 3/2017 | Gassauer | H01R 4/4863 |
| 9,793,636 | B2 * | 10/2017 | France | H01R 9/2491 |
| 10,193,245 | B2 * | 1/2019 | Lorenschat | H01R 43/18 |
| 10,998,649 | B2 * | 5/2021 | Lüdke | H01R 4/4836 |
| 11,374,338 | B1 * | 6/2022 | Tseng | H01R 4/64 |
| 11,424,558 | B2 * | 8/2022 | Stjepanovic | H01R 11/09 |
| 2012/0064780 | A1 | 3/2012 | Wu et al. | |

FOREIGN PATENT DOCUMENTS

| | | | | | |
|---|---|---|---|---|---|
| CN | 108933338 | | * | 12/2018 | |
| CN | 208209144 | | | 12/2018 | |
| CN | 111864419 | A | * | 10/2020 | H01R 4/4863 |
| CN | 112003095 | | | 11/2020 | |
| CN | 112382865 | | * | 2/2021 | |
| DE | 2550943 | A1 | | 9/1976 | |
| DE | 19611762 | A1 | * | 10/1997 | H01R 12/515 |
| DE | 19611762 | A1 | | 10/1997 | |
| DE | 20100939 | U1 | | 5/2002 | |
| DE | 102005060410 | A1 | | 6/2007 | |
| DE | 102013109640 | A1 | | 3/2015 | |
| DE | 202018106870 | U1 | * | 6/2019 | |
| DE | 102019111159 | A1 | | 11/2020 | |
| JP | H05129039 | A | | 5/1993 | |

* cited by examiner

COIL SPRING TYPE WIRE-LOCKING TERMINAL BLOCK

CROSS-REFERENCE TO RELATED APPLICATION

This application claims the priority benefit of China application serial no. 202110827565.7, filed on Jul. 21, 2021. The entirety of the above-mentioned patent application is hereby incorporated by reference herein and made a part of this specification.

BACKGROUND

Technical Field

The present application relates to the technical field of terminal blocks, and in particular to a coil spring type wire-locking terminal block.

Description of Related Art

A terminal block, also referred to a terminal strip, an electrical connector and the like, is now an electronic component for circuit connection. The electrical connector includes a rectangular electrical connector and a round electrical connector. Since the structure is simple, the rectangular electrical connector is mostly applied to a printed circuit board of an electronic device.

SUMMARY

The present application provides a coil spring type wire-locking terminal block, which facilitates the mounting and removal of wires.

The coil spring type wire-locking terminal block according to the present application adopts the following technical solutions.

A coil spring type wire-locking terminal block includes a plurality of insulating seats arranged in sequence. A mounting groove is formed in each of the plurality of insulating seats, a wire inlet hole configured for a wire to pass therethrough is formed in one side wall of the mounting groove, a connecting terminal is mounted at the bottom of the mounting groove, one end of the connecting terminal penetrates through the bottom of the mounting groove, and a first through hole configured for the wire to pass therethrough is formed at one side of the connecting terminal. A wire locking frame is slidably connected in the mounting groove, and a compression elastic member is arranged in the wire locking frame. One end of the compression elastic member is mounted on the inner side at the top of the wire locking frame, and the other end of the compression elastic member is mounted at the top of the connecting terminal. A second through hole configured for the wire to pass through is formed in the side wall of the wire locking frame. The wire inlet hole, the first through hole and the second through hole are arranged corresponding to each other. A top plate of the connecting terminal penetrates through the second through hole, and a driving assembly for driving the wire locking frame to move toward the connecting terminal is mounted at the top of each of the insulating seats.

By adopting the above technical solution, at an initial position, the wire locking frame is pushed to the highest position under the tension action of the upward compression elastic member, and at this time, the wire inlet hole is shielded and is in a closed state. When a wire needs to be mounted, the driving assembly pushes the wire locking frame to move downward, and after the wire inlet hole, the first through hole and the second through hole are aligned by pushing the wire locking frame to move downward, one end of the wire passes through the wire inlet hole, the first through hole and the second through hole in turn by moving the wire, and then the support for the wire locking frame is removed by the driving assembly. In this case, the wire locking frame is returned upward under the action of the compression elastic member, and the wire is clamped between the terminal and the wire locking frame under the action of the second through hole of the wire locking frame. Thus, the wire can be mounted. When the wire needs to be removed, the wire locking frame is driven by the driving assembly to move downward until the wire inlet hole, the first through hole and the second through hole are aligned and then the wire is removed. In summary, by arranging the above structure, it is convenient to mount and remove the wire.

Preferably, a third through hole is formed at the top of the mounting groove, the driving assembly includes a rotating shaft rotatably connected to one side wall of the third through hole, the rotating shaft is located on the side of the wire locking frame away from the connecting terminal, a pressing plate is fixedly connected to the rotating shaft, and one end of the pressing plate abuts against the top of the wire locking frame.

By adopting the above technical solution, the pressing plate is arranged to facilitate the driving of the wiring frame to move downward.

Preferably, the pressing plate includes a pressing portion and a pushing portion, one side of the pressing portion adjacent to the wire locking frame is of an arc shape, and the pressing portion is eccentrically connected to the rotating shaft.

By adopting the above technical solution, it is convenient to drive the wire locking frame to move downward.

Preferably, a perforation for one end of the connecting terminal away from wire locking frame to pass through is formed at the bottom of the mounting groove, and one end of the perforation runs through one side of the insulating seat.

By adopting the above technical solution, it is convenient to install the connecting terminals.

Preferably, the number of the second through holes is two, and the two second through holes are formed in the two sides of the wire locking frame respectively, two notches are formed at each side of the top of the connecting terminals, and four side walls of the two second through holes are slidably connected to the four notches in one-to-one correspondence.

By adopting the above technical solution, the wire locking frame can be moved more stably, thereby facilitating to mount the wires.

Preferably, a first connecting assembly is arranged between adjacent two of the insulating seats, the first connecting assembly includes a plurality of mushroom-shaped heads mounted on one side of one insulating seat, a plurality of mushroom-shaped holes are formed in one side of the other insulating seat, and the mushroom-shaped heads are clamped in the mushroom-shaped holes in one-to-one correspondence.

By adopting the above technical solution, the mushroom-shaped head and the mushroom-shaped hole are arranged to facilitate the connection between the two adjacent insulation seats.

Preferably, the mushroom-shaped head includes a root portion and a head portion, the diameter of the head portion is larger than the diameter of the root portion, and the head portion is elastic, and the shape of the mushroom-shaped hole is the same as the shape of the mushroom-shaped head.

By adopting the above technical solution, the mushroom-shaped head is conveniently clamped to the mushroom-shaped hole.

Preferably, a side cover is mounted on one side of an outermost one of the insulating seats, the side cover is detachably connected to one side of the insulating seat via a second connecting assembly, and the second connecting assembly and the first connecting assembly have the same structure.

By adopting the above technical solution, the side cover is arranged to shield the mounting grooves on the outermost insulating seats, thereby reducing the possibility of electricity shock by the operator. The second connecting assembly is arranged to facilitate the installation of the side cover.

In summary, the present application has the following beneficial effects.

1. At the initial position, the wire locking frame is pushed to the highest position under the tension action of the upward compression elastic member, and at this time, the wire inlet hole is shielded and is in a closed state. When a wire needs to be mounted, the driving assembly pushes the wire locking frame to move downward, and after the wire inlet hole, the first through hole and the second through hole are aligned by pushing the wire locking frame to move downward, one end of the wire passes through the wire inlet hole, the first through hole and the second through hole in turn by moving the wire, and then the support for the wire locking frame is removed by the driving assembly. In this case, the wire locking frame is returned upward under the action of the compression elastic member, and the wire is clamped between the terminal and the wire locking frame under the action of the second through hole of the wire locking frame. Thus, the wire can be mounted. When the wire needs to be removed, the wire locking frame is driven by the driving assembly to move downward until the wire inlet hole, the first through hole and the second through hole are aligned and then the wire is removed. In summary, by arranging the above structure, it is convenient to mount and remove the wire.

2. The side cover is arranged to shield the mounting grooves on the outermost insulating seats, thereby reducing the possibility of getting electrical shock for an operator. The second connecting assembly is arranged to facilitate installation of the side cover.

DESCRIPTION OF THE EMBODIMENTS

In existing technologies, reference may be made to a Chinese utility model patent with publication number CN208209144U, which discloses a wiring terminal block integrated with a header connector, the wiring terminal block includes a PCB (Printed Circuit Board) fixed on a base housing and side covers fixed on two sides of the PCB. The PCB is provided with a plurality of terminal strip plug-in holes in which the wiring terminal strips can be inserted, and the wiring terminal strips are electrically connected with the PCB through the terminal strip plug-in holes. The PCB is provided with a header connector, and each external power supply connecting end on the wiring terminal strip forms a one-to-one connection with each control signal input/output end on the header connector via an etching circuit on the PCB circuit board. The header connector and the wiring terminal strip are integrated, so that the header connector is adopted at the input end, and a PLC input end or an output end is quickly connected through a cable.

In existing technologies, reference may be made to a Chinese invention patent application document with the publication number of CN112003095A, which discloses a terminal strip including an insulating seat, a screw, a resistance strain gauge, a first detection circuit and a main control chip, a plurality of ports wrapped with a metal frame are formed in one surface of the insulating seat, a first electrode and a second electrode are arranged at intervals on the inner surface of a sidewall of a port, one end of each wire is inserted into each port and is in contact with the first electrode and the second electrode, a plurality of resistance strain gauges are embedded in the insulating seat, each resistance strain gauge faces one side wall of each port, and a distance is formed between each resistance strain gauge and one side wall of the port; one end of each screw penetrates through the insulating seat and is inserted into each port from the other side wall of each port, the screws can rotate, so that the screws move towards the wire and are tightly pressed against the wire. Each resistance strain gauge is electrically connected with the first detection circuit, and the first detection circuit is electrically connected with the main control chip. The terminal strip can detect the fastening state of the screw, and the state of the wire, so as to eliminate the faults.

However, the described insulating seat fixes the wire via a screw, and it is well known that the screw is easy to be slipped, and after the screw is slipped, it may be inconvenient to mount and remove the wire.

Figure 1:
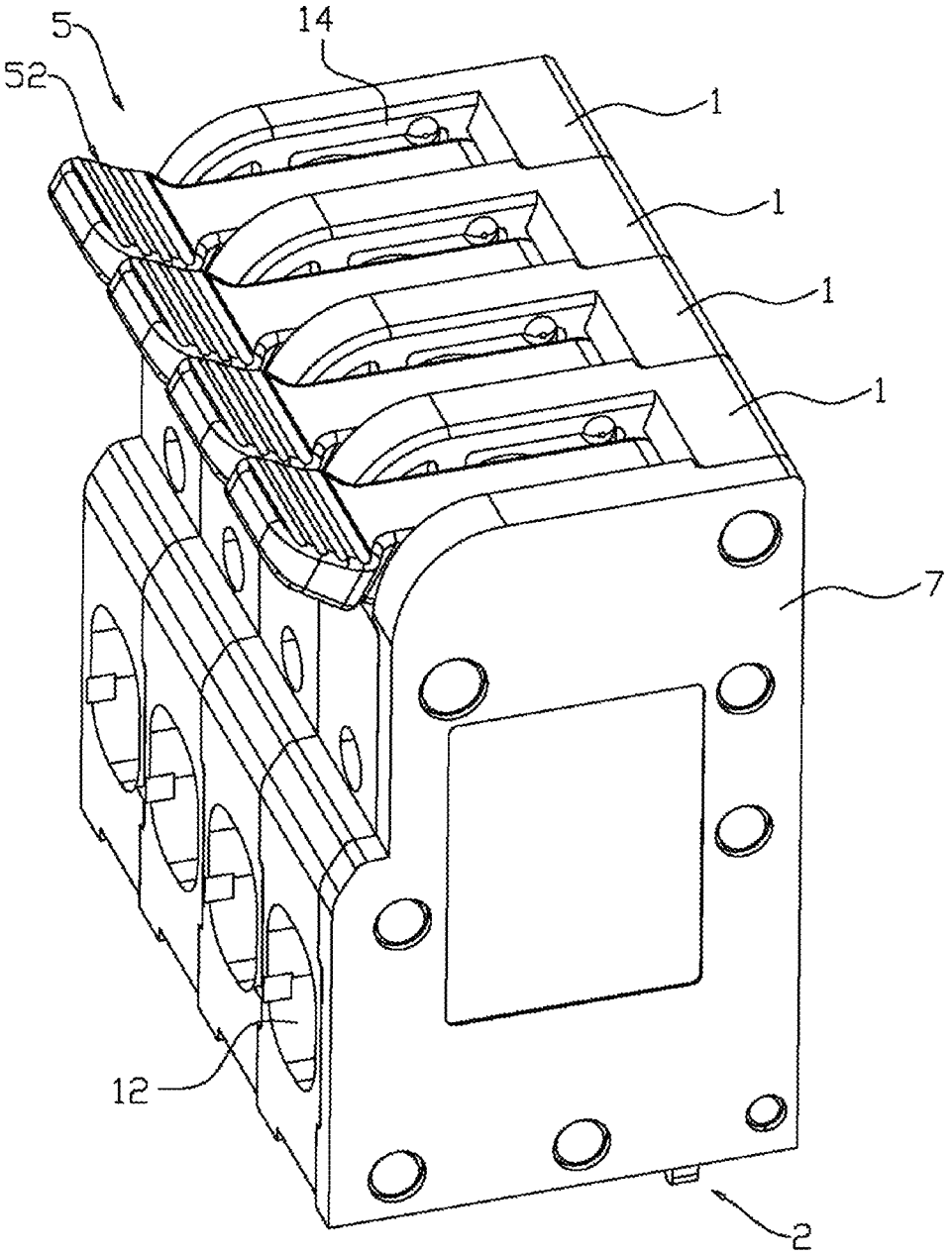
FIG. 1 is a schematic diagram of an overall structure in an embodiment of the present application.
Figure 2:
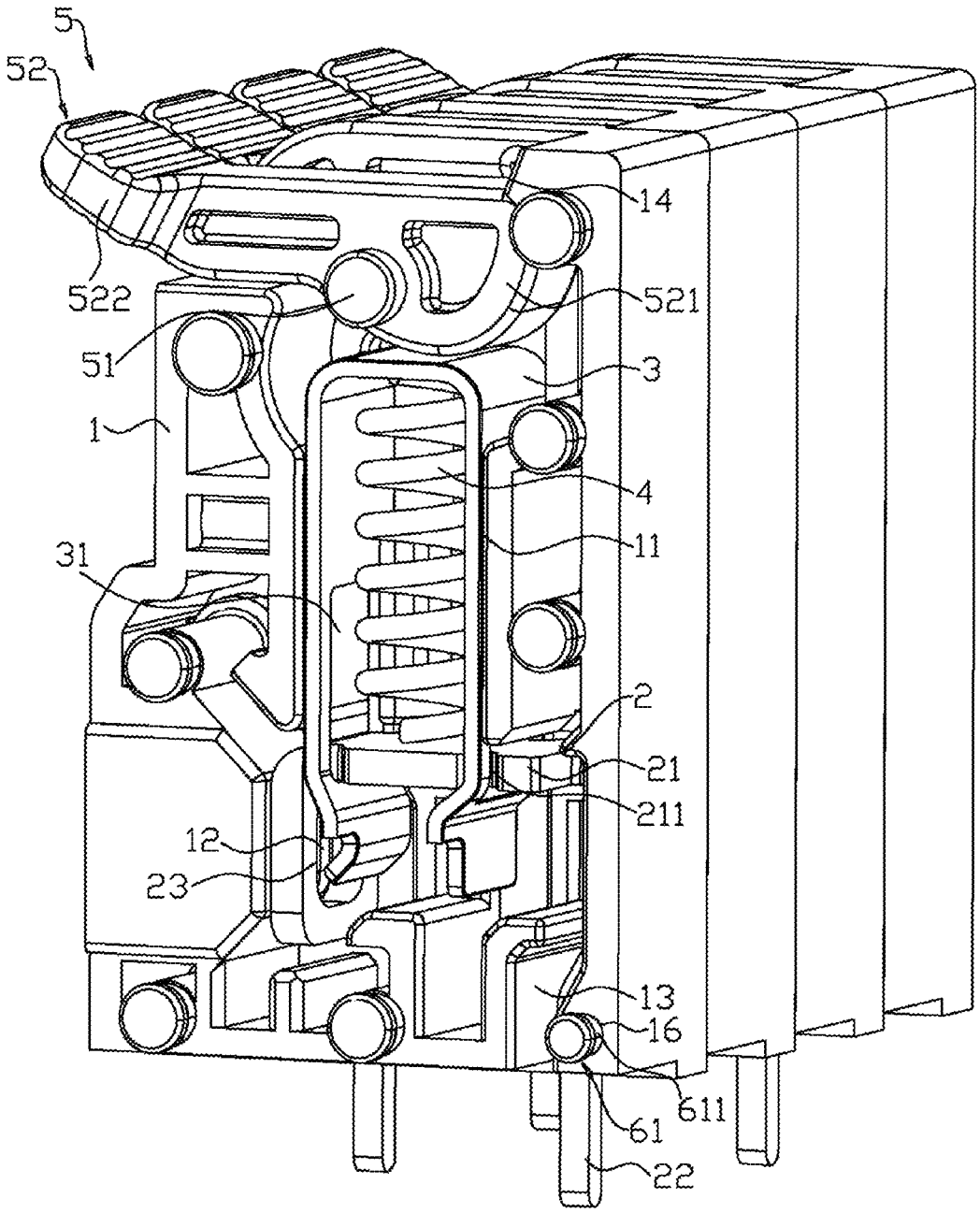
FIG. 2 is a structural schematic diagram for highlighting a wire locking frame and a spring in an embodiment of the present application.
Figure 3:
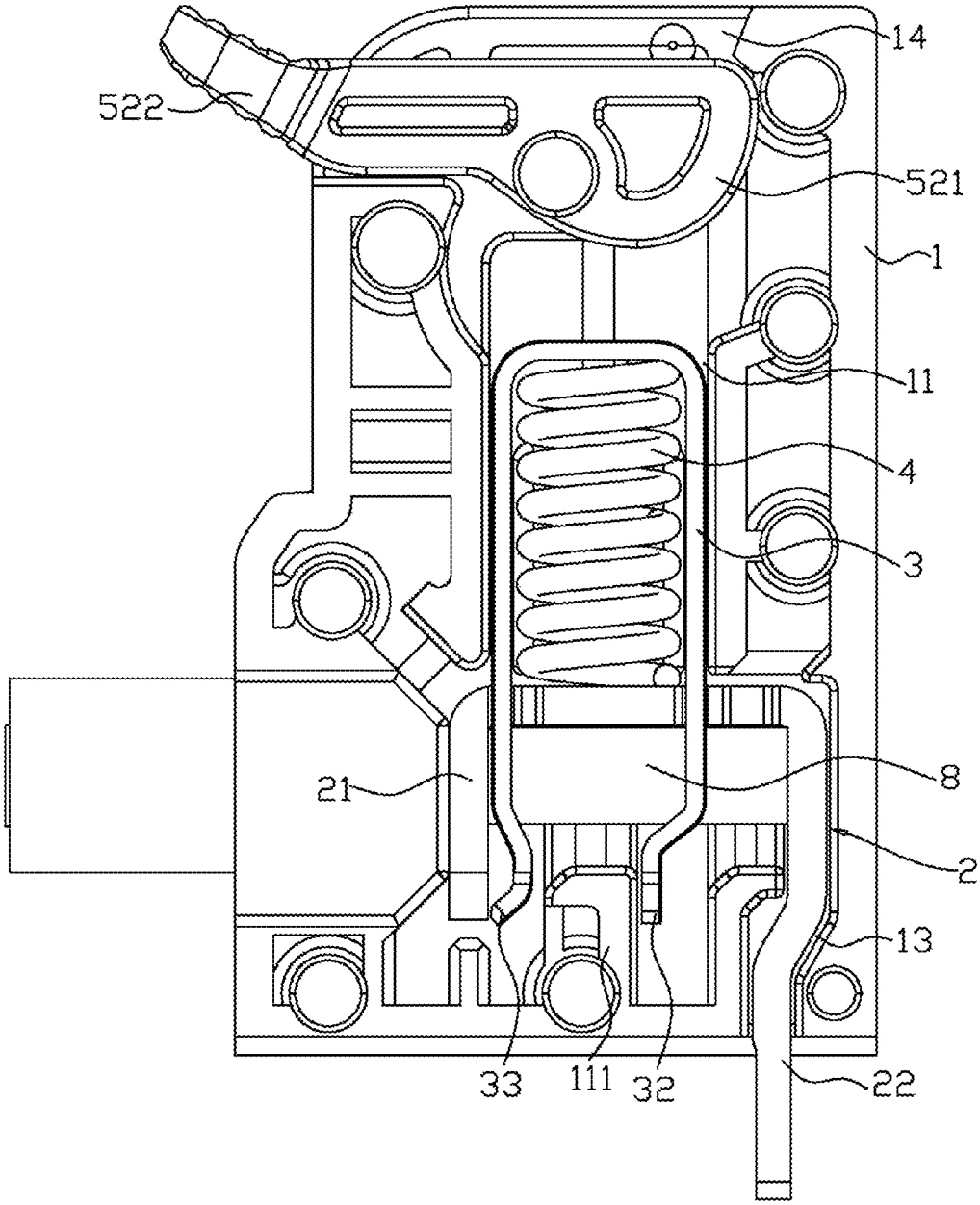
FIG. 3 is a structural schematic diagram for highlighting a connecting terminal according to an embodiment of the present application.

This application discloses a coil spring type wire-locking terminal block, as shown in FIG. 1 and FIG. 2, the terminal block includes a plurality of insulating seats 1 arranged in sequence, and a vertically arranged mounting groove 11 is formed in each insulating seat 1. The mounting groove 11 runs through one side of the insulating seat 1, a wire inlet hole 12 for a wire 8 to pass therethrough is formed in one side wall of the mounting groove 11, and the wire inlet hole 12 extends along the length direction of the insulating seat 1. With reference to FIG. 3, a connecting terminal 2 is mounted at the bottom of the mounting groove 11, and the connecting terminal 2 includes a connecting portion 21 fixedly connected to the bottom of the mounting groove 11 and a plug-in portion 22 fixedly connected to the bottom of the connecting portion 21. A perforation 13 for passing through the plug-in portion 22 is formed on the bottom of the mounting groove 11, and one end of the perforation 13 runs through one side of the insulating seat 1.

As shown in FIG. 2 and FIG. 3, a first through hole 23 for the wire 8 to pass therethrough is formed at one side of the connecting terminal 2. A wire locking frame 3 is slidably connected in the mounting groove 11 along the vertical direction, the wire locking frame 3 is U-shaped, a compression elastic member is arranged in the wire locking frame 3, and the compression elastic member is a spring 4. One end of the spring 4 is fixedly connected to the inner side of the top of the wire locking frame 3, and the other end of the spring 4 is fixedly connected to the top of the connecting portion 21. A second through hole 31 for the wire 8 to pass through is formed in the side wall of the wire locking frame 3, the second through hole 31 extends vertically, and the wire inlet hole 12, the first through hole 23 and the second through hole 31 are arranged corresponding to each other. A top plate of the connecting portion 21 penetrates through the second through hole 31, and a driving assembly 5 for driving the wire locking frame 3 to move toward the connecting terminal 2 is mounted at the top of the insulating seat 1. In order to reduce the possibility that the wire locking frame 3 is moved under the action of an external force, the first abutting portion 32 and the second abutting portion 33 are respectively provided on both sides of the bottom of the wire locking frame 3. The first abutting portion 32 is vertically arranged, and the bottom of the mounting groove 11 is fixedly connected to a stopper 111, and the first abutting portion 32 can abut against the side of the stopper 111 close to a plug-in portion 22. The second abutting portion 33 is V-shaped, and the second abutting portion 33 can abut against an inner wall of one end of the connecting portion 21 away from the plug-in portion 22. At the initial position, the wire locking frame 3 is pushed to the highest position under the tension action of the upward spring 4, and at this time, the wire inlet hole 12 is shielded and is in a closed state. When a wire 8 needs to be mounted, the driving assembly 5 pushes the wire locking frame 3 to move downward, and after the wire inlet hole 12, the first through hole 23 and the second through hole 31 are aligned by pushing the wire locking frame 3 to move downward, one end of the wire 8 passes through the wire inlet hole 12, the first through hole 23 and the second through hole 31 in turn by moving the wire 8, and then the support for the wire locking frame 3 is removed by the driving assembly 5. In this case, the wire locking frame 3 is returned upward under the action of the spring 4, and the wire 8 is clamped between the terminal and the wire locking frame 3 under the action of the second through hole 31 of the wire locking frame 3. Thus, the wire 8 can be mounted. When the wire 8 needs to be removed, the wire locking frame 3 is driven by the driving assembly 5 to move downward until the wire inlet hole 12, the first through hole 23 and the second through hole 31 are aligned and then the wire 8 is removed. In summary, by arranging the above structure, it is convenient to mount and remove the wire 8.

Figure 4:
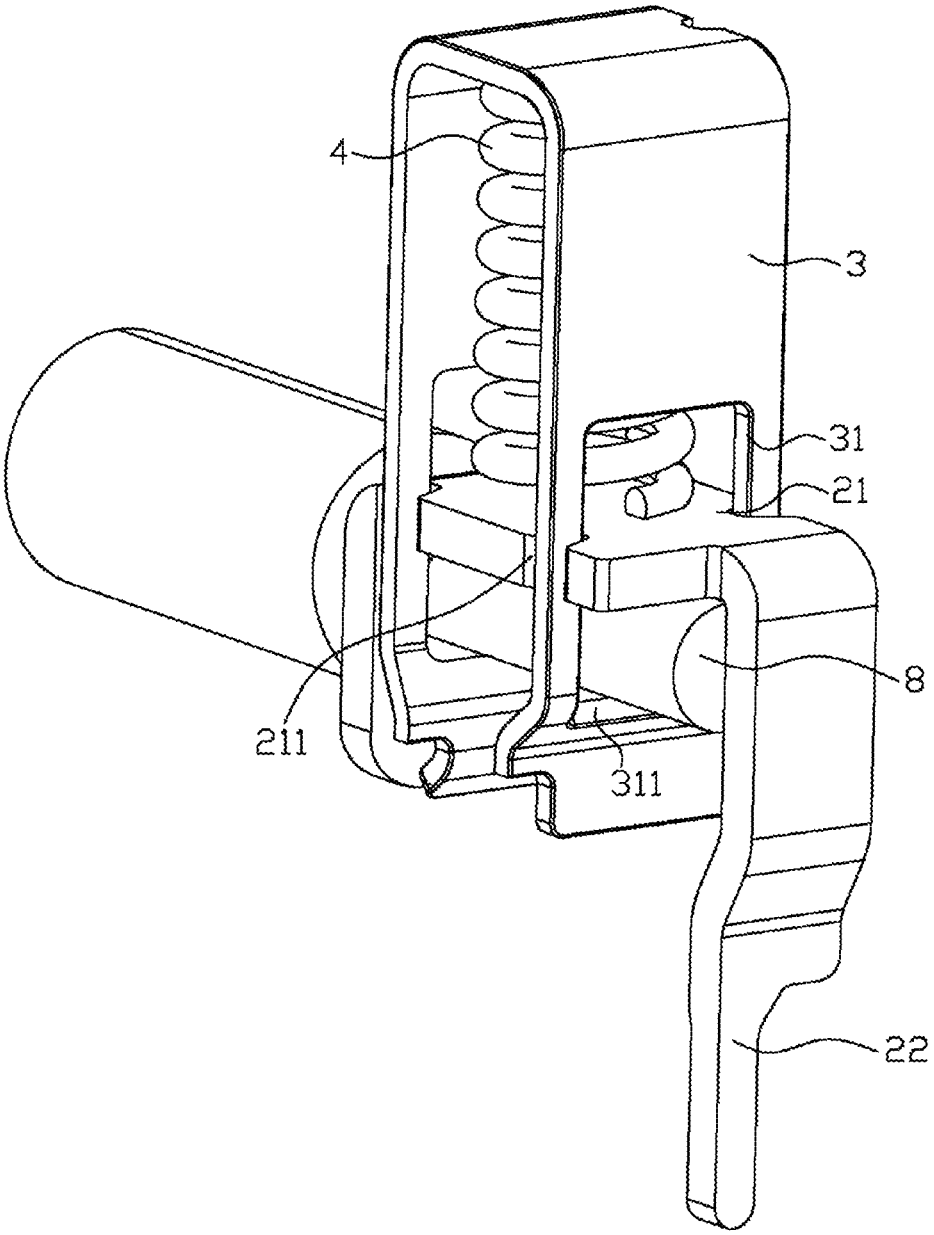
FIG. 4 is a structural schematic diagram for highlighting a blade portion in an embodiment of the present application.

As shown in FIGS. 3 and 4, the number of the second through holes 31 is two, and the two second through holes 31 are formed in the two sides of the wire locking frame 3 respectively. In order to increase the firmness of the wire 8 being fixed, the bottom wall of the second through hole 31 is integrally formed with a blade portion 311, and the blade tip of the blade portion 311 can be brought into contact with the sidewall of the wire 8, so that the blade tip of the blade portion 311 can be fitted into the sidewall of the wire 8 under the elastic force of the spring 4. Two notches 211 are formed at each side of the top of the connecting portion 21, and four side walls of the two second through holes 31 are slidably connected to the four notches 211 in one-to-one correspondence along the vertical direction. The wire locking frame 3 can be moved more stably by the arranged notch 211, thereby facilitating the mounting of the wire 8.

Figure 5:
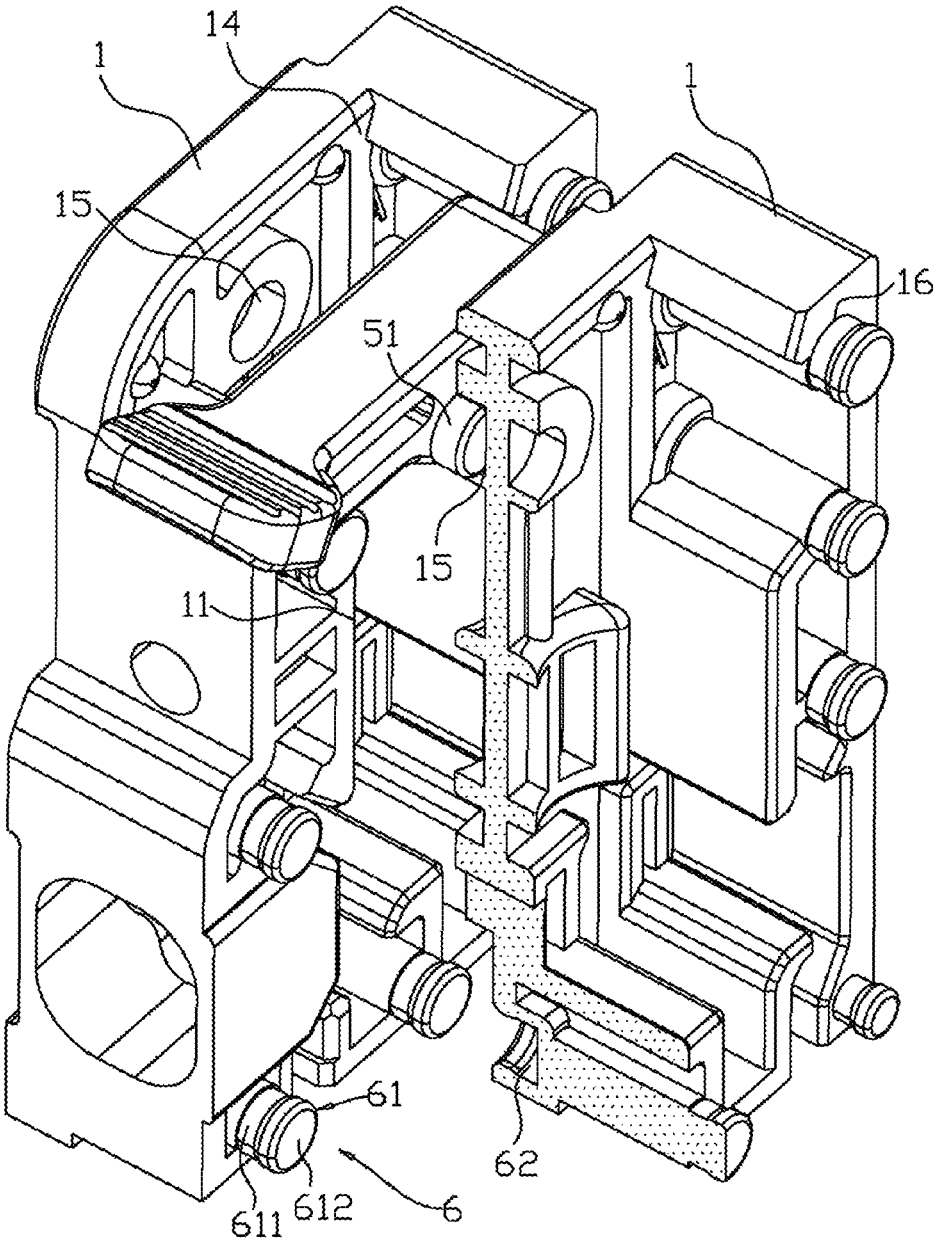
FIG. 5 is a partial cross-sectional view for highlighting a first connecting assembly in an embodiment of the present application.
Figure 6:
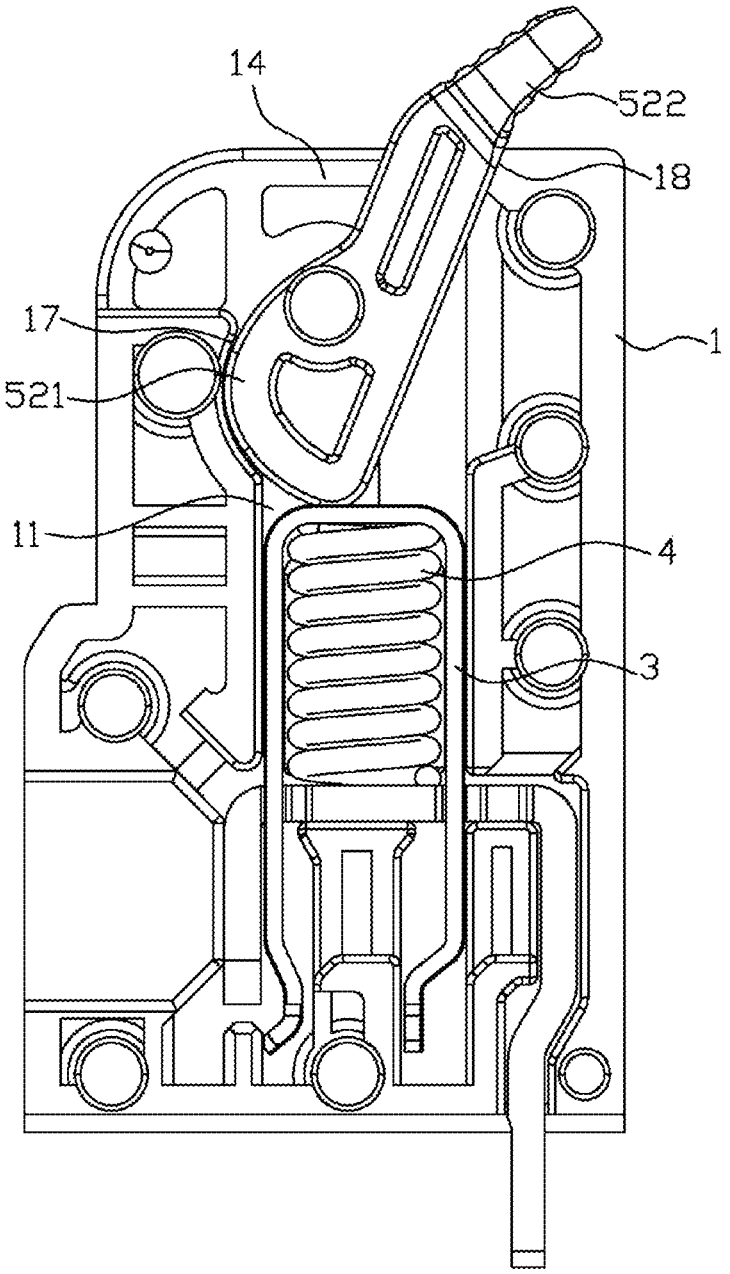
FIG. 6 a structural schematic diagram for highlighting an arc-shaped groove and an inclined surface in an embodiment of the present application.

As shown in FIG. 2 and FIG. 5, a third through hole 14 is formed at the top of the mounting groove 11, the driving assembly 5 includes a rotating shaft 51 rotatably connected to one side wall of the third through hole 14, and one side of the third through hole 14 is provided with a cylindrical groove 15. In order to enhance the rotating stability of the rotating shaft 51, the cylindrical groove 15 for the rotating shaft 51 to rotate is also formed in the adjacent insulating seats 1. The cylindrical groove 15 extends along the width direction of the insulating seat 1, the rotating shaft 51 is in clearance fit with the cylindrical groove 15, and the rotating shaft 51 is located above the wire locking frame 3. A pressing plate 52 is fixedly connected to the rotating shaft 51, the pressing plate 52 includes a pressing portion 521 and a pushing portion 522. One side of the pressing portion 521 close to the wire locking frame 3 is of an arc shape, the pressing portion 521 is eccentrically connected to the rotating shaft 51, and one end of the pressing plate portion 521 abuts against the top of the wire locking frame 3. The height of the third through-hole 14 on the side away from the wire inlet hole 12 is higher than the height of the third through-hole 14 on the side close to the wire inlet hole 12, so that on the one hand, the pushing portion 522 is convenient to place, and on the other hand, the pushing portion 522 is convenient to limit. With reference to FIG. 6, in order to reduce the possibility that the pressing plate 52 rotates under the elastic force of the spring 4, an arc-shaped groove 17 is provided on the side wall of the mounting groove 11 for plugging the pressing portion 521, and an inclined surface 18 is provided on the side of the third through hole 14 away from the arc-shaped groove 17 for pushing the pressing portion 522 to contact.

As shown in FIG. 1 and FIG. 5, a first connecting assembly 6 is arranged between two adjacent insulating seats 1, the first connecting assembly 6 includes a plurality of mushroom-shaped heads 61 mounted on one side of one insulating seat 1. A mounting hole 16 for mounting a mushroom-shaped head 61 is provided in the insulating seat 1. The mushroom-shaped head 61 includes a root portion 611 and a head portion 612, the diameter of the head portion 612 is larger than the diameter of the root portion 611, the head portion 612 is elastic, and the head portion 612 is made up of PA66 plastic without fiberglass. A plurality of mushroom-shaped holes 62 are formed in one side of the other insulating seat 1, and the mushroom-shaped heads 61 are clamped in the mushroom-shaped holes 62 in one-to-one correspondence, and the shape of the mushroom-shaped hole 62 is the same as the shape of the mushroom-shaped head 61. The mushroom-shaped head 61 is clamped to the mushroom-shaped hole 62 in one-to-one correspondence. The mushroom-shaped head 61 and the mushroom-shaped hole 62 are arranged to facilitate connection between two adjacent insulating seats 1.

As shown in FIG. 1 and FIG. 5, a side cover 7 is mounted on one side of an outermost insulating seat 1, the side cover 7 is detachably connected to one side of the insulating seat 1 via a second connecting assembly, and the second connecting assembly and the first connecting assembly 6 have the same structure, and the structure of the second connecting assembly is not described herein again. The edge cover 7 is arranged to shield the mounting groove 11 on the outermost insulating seat 1, so as to reduce the possibility of electricity shock by the operator. The second connecting assembly is arranged to facilitate the mounting of the side cover 7.

Working principle is described as follows. At the initial position, the wire locking frame 3 is pushed to the highest position under the tension action of the upward spring 4, and at this time, the wire inlet hole 12 is shielded and is in a closed state. When a wire 8 needs to be mounted, the driving assembly 5 pushes the wire locking frame 3 to move downward, and after the wire inlet hole 12, the first through hole 23 and the second through hole 31 are aligned by pushing the wire locking frame 3 to move downward, one end of the wire 8 passes through the wire inlet hole 12, the first through hole 23 and the second through hole 31 in turn by moving the wire 8, and then the support for the wire locking frame 3 is removed by the driving assembly 5. In this case, the wire locking frame 3 is returned upward under the action of the spring 4, and the wire 8 is clamped between the terminal and the wire locking frame 3 under the action of the second through hole 31 of the wire locking frame 3. Thus, the wire 8 can be mounted. When the wire 8 needs to be removed, the wire locking frame 3 is driven by the driving assembly 5 to move downward until the wire inlet hole 12, the first through hole 23 and the second through hole 31 are aligned and then the wire 8 is removed. In summary, by arranging the above structure, it is convenient to mount and remove the wire 8.

The above description is only preferred embodiments of the present application and is not intended to limit the protection scope of the present application. Therefore, all equivalent changes of the structure, shape or principle according to the spirit of the present application should be all included in the protection scope of the present application.

What is claimed is:

1. A wire-locking terminal block, comprising a plurality of insulating seats arranged in sequence, wherein a mounting groove is formed in each of the plurality of insulating seats, a wire inlet hole configured for a wire to pass therethrough is formed in one side wall of the mounting groove, a connecting terminal is mounted at a bottom of the mounting groove, one end of the connecting terminal penetrates through the bottom of the mounting groove, and a first through hole for the wire to pass therethrough is formed at one side of the connecting terminal; a wire locking frame is slidably connected in the mounting groove, a compression elastic member is arranged in the wire locking frame, one end of the compression elastic member is mounted on an inner side at a top of the wire locking frame, and a second end of the compression elastic member is mounted at a top of the connecting terminal; a second through hole configured for the wire to pass therethrough is formed in a side wall of the wire locking frame, and the wire inlet hole, the first through hole and the second through hole are arranged corresponding to each other; and a top plate of the connecting terminal penetrates through the second through hole, and a driving assembly configured for driving the wire locking frame to move toward the connecting terminal is mounted at a top of each of the plurality of insulating seats, wherein a first connecting assembly is arranged between adjacent two of the plurality of insulating seats, the first connecting assembly comprises a plurality of mushroom-shaped heads mounted on one side of one of the adjacent two of the plurality of insulating seats, a plurality of mushroom-shaped holes are formed in one side of a second one of the adjacent two of the plurality of insulating seats, and the plurality of mushroom-shaped heads are snap connected in the plurality of mushroom-shaped holes in one-to-one correspondence.

2. The wire-locking terminal block according to claim 1, wherein a third through hole is formed at a top of the mounting groove, the driving assembly comprises a rotating shaft rotatably connected to a side wall of the third through hole, the rotating shaft is located at a side of the wire locking frame away from the connecting terminal, a pressing plate is fixedly connected to the rotating shaft, and one end of the pressing plate abuts against the top of the wire locking frame.

3. The wire-locking terminal block according to claim 2, wherein the pressing plate comprises a pressing portion and a pushing portion, one side of the pressing portion adjacent to the wire locking frame is of an arc shape, and the pressing portion is eccentrically connected to the rotating shaft.

4. The wire-locking terminal block according to claim 1, wherein a perforation configured for an end of the connecting terminal away from wire locking frame to pass through is formed at the bottom of the mounting groove, and one end of the perforation runs through one side of each of the plurality of insulating seats.

5. The wire-locking terminal block according to claim 1, wherein a number of the second through holes is two, and the two second through holes are formed in two sides of the wire locking frame respectively, two notches are formed at each side of the top of the connecting terminal such that there are four notches, and four side walls of the two second through holes are slidably connected to the four notches in one-to-one correspondence.

6. The wire-locking terminal block according to claim 1, wherein each of the plurality of mushroom-shaped heads comprises a root portion and a head portion, a diameter of the head portion is larger than a diameter of the root portion, and the head portion is elastic; and a shape of each of the plurality of mushroom-shaped holes conforms to a shape of each of the plurality of mushroom-shaped heads.

7. The wire-locking terminal block according to claim 6, wherein a side cover is mounted on one side of an outermost one of the plurality of insulating seats, the side cover is detachably connected to one side of the outermost one of the plurality of insulating seats via a second connecting assembly, and the second connecting assembly and the first connecting assembly have a same structure.

* * * * *